US010196785B2

(12) United States Patent
Starossek

(10) Patent No.: US 10,196,785 B2
(45) Date of Patent: Feb. 5, 2019

(54) DEVICE FOR DAMPING VIBRATIONS OF A BRIDGE

(71) Applicants: TECHNISCHE UNIVERSITÄT HAMBURG-HARBURG, Hamburg (DE); TUTECH INNOVATION GMBH, Hamburg (DE)

(72) Inventor: Uwe Starossek, Hamburg (DE)

(73) Assignees: TuTech Innovation GmbH, Hamburg (DE); Technical University Hamburg-Harburg, Hamburg (DE)

( * ) Notice: Subject to any disclaimer, the term of this patent is extended or adjusted under 35 U.S.C. 154(b) by 0 days.

(21) Appl. No.: 15/564,856

(22) PCT Filed: Apr. 8, 2015

(86) PCT No.: PCT/EP2015/057604
§ 371 (c)(1),
(2) Date: Oct. 6, 2017

(87) PCT Pub. No.: WO2016/162059
PCT Pub. Date: Oct. 13, 2016

(65) Prior Publication Data

US 2018/0112364 A1 Apr. 26, 2018

(51) Int. Cl.
*E01D 19/00* (2006.01)
*E01D 19/04* (2006.01)
*E01D 11/02* (2006.01)

(52) U.S. Cl.
CPC ..... *E01D 19/04* (2013.01); *E01D 11/02* (2013.01); *E01D 19/00* (2013.01)

(58) Field of Classification Search
CPC ..... E01D 11/02; E01D 19/04; E01D 19/00
USPC ..... 14/78
See application file for complete search history.

(56) References Cited

U.S. PATENT DOCUMENTS 3,047,914 A * 8/1962 Kahn ..... E06B 7/084 49/390
3,132,363 A * 5/1964 Roberts ..... E01D 11/02 14/18
4,741,063 A * 5/1988 Diana ..... E01D 11/02 14/18
5,615,436 A * 4/1997 Brown ..... E01D 11/02 14/18

(Continued)

FOREIGN PATENT DOCUMENTS

EP 0233528 A2 8/1987
JP H08158314 A 6/1996

(Continued)

*Primary Examiner* — Raymond W Addie
(74) *Attorney, Agent, or Firm* — Barclay Damon LLP

(57) ABSTRACT

A damping device for damping vibrations of a bridge with a bridge deck comprises at least one damping wing comprising a center and configured to dampen vibrations of the bridge. A longitudinal direction of the at least one damping wing is disposed parallel to a longitudinal direction of the bridge deck and the at least one damping wing is stationary upon wind acting on the bridge in a given direction. At least one support structure is laterally attached to at least one side of the bridge deck and configured to attach the at least one damping wing to the bridge deck such that the at least one damping wing is disposed with a lateral offset from an outer edge of the bridge deck facing the at least one damping wing.

20 Claims, 5 Drawing Sheets

(56) References Cited

U.S. PATENT DOCUMENTS

| | | | | | |
|---|---|---|---|---|---|
| 5,640,732 | A | * | 6/1997 | Diana | E01D 11/02<br>14/18 |
| 6,154,910 | A | * | 12/2000 | Corney | E01D 11/00<br>14/18 |

FOREIGN PATENT DOCUMENTS

| | | | | | |
|---|---|---|---|---|---|
| JP | H10140520 | A | | 5/1998 | |
| WO | 9316232 | | | 8/1993 | |
| WO | WO 94/10387 | | * | 10/1993 | E01D 11/00 |
| WO | 9410387 | | | 5/1994 | |
| WO | 2006050802 | A1 | | 5/2006 | |

* cited by examiner

DEVICE FOR DAMPING VIBRATIONS OF A BRIDGE

CROSS-REFERENCE TO RELATED APPLICATIONS

This application is a national stage application pursuant to 35 U.S.C. § 371 of International Application No. PCT/EP2015/057604, filed on Apr. 8, 2015. The entire contents of such application is hereby incorporated by reference.

BACKGROUND

The invention is directed to a device for damping vibrations of a bridge having a bridge deck. The device comprises at least one damping wing arranged along at least one side of the bridge deck. The at least one damping wing dampens vibrations of the bridge, wherein the longitudinal direction of the at least one damping wing is arranged parallel to the longitudinal direction of the bridge deck.

It is desired to build suspension bridges with large span lengths. For example the Akashi Kaikyo bridge built during the late 1990's in Japan has a span length of nearly 2000 meters. Such large bridge lengths lead to considerable issues with regard to vibrations. This includes in particular wind induced vibrations and flutter. During fluttering of bridges, torsional vibrations and bending vibrations occur. They are usually self induced vibrations in which the dynamic wind forces are induced by the vibrations of the bridge deck. Flutter is caused in particular by wind speeds that are constant over time, contrary to gusts of wind or the like. If the wind speed acting on the bridge exceeds a critical value, the structural damping of the bridge deck is overcome by negative aerodynamic damping. At a further increase of the wind speed a system with a negative total damping can occur in which a small initial deformation can lead to an increasing vibration with practically unlimited amplitude and thus failure of the bridge. The characteristic structural value for flutter stability of bridges is the critical wind speed $U_{cr}$. It is a known fact that $U_{cr}$ decreases with decreasing natural frequency of vibration and damping of the bridge. In particular bridges with large span lengths have low natural frequencies so that they are particularly prone to flutter.

From WO 2006/050802, a device for damping vibrations in particular in a bridge is known which comprises at least one aerodynamic control surface which is mounted in a rotational and/or displaceable manner and at least one mechanical damper which comprises a spring element. At least one constrained kinematic coupling is arranged between the mechanical damper and the aerodynamic control surface. Upon wind acting on the bridge the aerodynamic control surface is vibrating such that undesired vibrations of the bridge are dampened.

The known device has the advantage of being a passive system and, therefore, being highly reliable. However, it has moveable parts which make the implementation into a civil engineering structure an unusual task and possibly costly. It could also be argued that, even if more reliable than an active damper, it is in some ways less reliable because of moving parts that could fail.

Further, from EP 0 233 528 A2, a structure is known with fixed wings positioned with a vertical offset relative to the bridge deck. The wings are mounted on the hangers of a suspension bridge and, therefore, placed right above the edges of the bridge deck. While this known device has the advantage of no moveable parts and thus is particularly robust and reliable, it does not satisfactorily dampen vibrations of the bridge in practice.

Starting from the prior art described above it is the object of the invention to provide a device for damping vibrations of a bridge which is of robust and reliable construction and at the same time highly efficient with regard to damping of vibrations of a bridge.

The invention solves this object with a device according to claim 1. Advantageous embodiments can be found in the dependent claims, the specification and the drawings.

BRIEF SUMMARY OF THE INVENTION

The invention solves the object in that the at least one damping wing is arranged on at least one support structure, wherein said at least one support structure is laterally attached to the bridge deck such that the at least one damping wing is arranged with a lateral offset from the outer edge of the bridge deck facing the at least one damping wing, wherein the distance between the center of the at least one damping wing and the center of the bridge deck is at least 1.2 times larger than half the width of the bridge deck, preferably at least 1.5 times larger than half the width of the bridge deck, and in that the at least one damping wing is permanently stationary or stationary upon wind acting on the bridge in a given direction.

The bridge, which is provided with the inventive device can be a suspension bridge, in particular a suspension bridge with a large span length of for example more than 1000 meters or more than 2000 meters. The inventive device serves for damping wind induced vibrations of the bridge, in particular flutter of the bridge. The inventive device dampens or suppresses such vibrations and thus stabilizes the bridge structure.

According to the invention at least one damping wing is arranged on at least one support structure, which support structure is laterally attached to the bridge deck. The damping wing and the support structure are both light-weight components. Depending on the support structure the at least one damping wing can have the shape, thickness, strength and stiffness of an airfoil or can be a thin plate. Its profile may be symmetrical about a horizontal plane and it may in particular be shaped such that the aerodynamic lift, under inclined wind, is large and the aerodynamic resistance is small. The longitudinal direction of the at least one wing is arranged parallel to the longitudinal direction of the bridge deck. Transverse to this longitudinal direction of the at least one damping wing is the aerodynamically active wing profile. The mechanical support structure provides a fixed spatial relationship between the bridge deck and the at least one damping wing and is embodied such that the at least one damping wing is fixed at least at a given wind direction (i.e. does not move). In particular, the wing itself does not move relative to the bridge deck and the wing does not have moving parts at least as long as the wind direction does not change. Other than the support structure, no connection between the at least one damping wing and the bridge deck is necessary. In particular, no kinematic coupling between the at least one damping wing and a mechanical damper or the like is provided. This makes the inventive device constructionally simple, robust and reliable.

At the same time, the support structure is arranged such that the at least one wing has a lateral distance to the outer edge of the bridge deck which is closest to the wing. The distance between the center of the at least one damping wing and the center of the bridge deck is at least 1.2 times larger than half the width of the bridge deck, preferably at least 1.5 times larger than half the width of the bridge deck. The center of the wing is the middle of the profile depth of the wing (i.e. the middle of the extension of the wing perpendicular to its longitudinal direction). If the wing is supported moveable such that it can assume different positions at different wind directions (see below), then the distance referred to in this regard is measured at a wind acting on the bridge deck whose direction is perpendicular to the longitudinal direction of the bridge deck and when the respective damping wing is on the leeward side of the bridge deck.

The inventor of this invention has found that providing the at least one fixed wing in this manner with a large lateral eccentricity from the bridge deck greatly increases efficiency of the vibration damping properties. The effect of the inventive fixed wing as a flutter stabilizer on the critical wind speed $U_{cr}$ has been investigated by the inventor with a finite element flutter analysis program. The program is capable of modelling and analyzing spatial bridge systems with multiple degrees of freedom including both the bridge deck and the at least one damping wing. Parametric computations have been performed for a long-span suspension bridge. The critical flutter wind speed $U_{cr}$ of the bridge without any damping wings was computed as 46.3 m/s. For one particular and feasible geometry of the inventive damping wing it has been shown with the analysis program that the critical flutter wind speed $U_{cr}$ can be raised with a device according to the invention by 64%. The inventor has also found that the flutter-suppression efficiency of the fixed-wing flutter stabilizer increases nonlinearly with, and mainly results from, the lateral eccentricity of the at least one damping wing.

Because the inventive damping wing does not move relative to the bridge deck (as long as the wind direction does not change) the inventive fixed wing flutter stabilizer is a static and not a dynamic device. Therefore, it is efficient also in raising the critical wind speed $U_{cr}$ for torsional divergence, a static aeroelastic stability phenomenon.

For optimum cost efficiency, it is preferable to place one or more damping wings not over the entire length of the bridge, but only at regions where large vibration amplitudes occur. In case flutter is governed by the first symmetric modes of vibration, these regions lie around the center of the main span. In case flutter is governed by the first antisymmetric modes of vibration, these regions lie around the quarter points of the main span.

According to a preferred embodiment, the width of the at least one damping wing in a direction transverse to its longitudinal direction is at least 0.02 times the width of the bridge deck, preferably at least 0.05 times the width of the bridge deck, more preferably at least 0.1 times the width of the bridge deck. The width of the damping wing is also called the profile depth of the wing (i.e. the extension of the wing perpendicular to its longitudinal direction). As explained above, the lateral eccentricity of the at least one wing is large. In particular the distance between the center of the at least one damping wing and the center of the bridge deck is at least 1.5 times larger than half the width of the bridge deck. Since efficiency of the damping wing increases with the lateral eccentricity, it may be advantageous to increase the explained value considerably above 1.5. The maximum in this regard will be mainly governed by constructional limits. Merely as an example, the above explained value may be up to 3.0. The inventor of this invention has found that another important parameter with regard to damping efficiency of the inventive damping wing(s) is the width of the wing(s). As explained, it may be at least 0.02 times the width of the bridge deck, preferably at least 0.05 times the width of the bridge deck, and more preferably at least 0.1 times the width of the bridge deck. Again, an upper limit will be governed by constructional conditions. It may, for example, be 0.25 times the width of the bridge deck.

According to a further embodiment, the at least one damping wing may be arranged on the at least one support structure such that the at least one damping wing is positioned with lateral offset from the outer edge of the bridge deck facing the at least one damping wing and above or below the bridge deck. Positioning the at least one wing with lateral offset but above or below the bridge deck with sufficient vertical offset avoids aerodynamic interference between the at least one wing and the bridge deck (including traffic) which may improve the efficiency of the at least one wing. Alternatively, it would also be possible to align the at least one wing horizontally with the bridge deck.

According to a further embodiment, a plurality of damping wings may be arranged on the at least one support structure, essentially at the same position along the longitudinal direction of the bridge deck and each with a lateral offset from the outer edge of the bridge deck facing the damping wings, wherein the plurality of damping wings are positioned above one another. According to a further embodiment in this regard, the plurality of damping wings may be positioned exactly above one another or may each have a lateral offset from one another. According to a further embodiment, the sum of the widths of the plurality of damping wings positioned above one another may be at least 0.02 times the width of the bridge deck, preferably at least 0.05 times the width of the bridge deck, more preferably at least 0.1 times the width of the bridge deck.

According to the above explained embodiments, a single damping wing is replaced by a certain number of damping wings positioned exactly or approximately above each other. The flutter suppression efficiency of such a group of wings is approximately the same as for a single wing, provided the sum of the widths of the plurality of wings is the same as the width of the original single wing and the vertical distance between the individual wings is not too small. This embodiment with a plurality of wings being positioned above one another offers less area of attack to the vertical velocity component of turbulent wind by taking advantage of the wind shielding effect provided by the uppermost or lowermost wings. Further advantages may be easier assembly and lower cost since the individual wings may be smaller.

According to a further embodiment, it is possible that at least one damping wing is arranged along each side of the bridge deck, wherein the longitudinal direction of each damping wing is arranged parallel to the longitudinal direction of the bridge deck. Each damping wing is arranged on at least one support structure and the at least one support structure is laterally attached to the bridge deck such that each damping wing is arranged with a lateral offset from the outer edge of the bridge deck facing the respective damping wing. The distance between the center of each damping wing and the center of the bridge deck is at least 1.5 times larger than half the width of the bridge deck, and wherein, upon wind acting on the bridge in a given direction, each damping wing is stationary, and wherein at least one of the damping wings dampens vibrations of the bridge. The damping wings arranged along both sides of the bridge deck may be identical with regard to their form and arrangement on the bridge deck. However, it is also possible that the damping wings arranged along both sides of the bridge deck differ from one another with regard to their form and/or their arrangement on the bridge deck.

For example, damping wings may be equally positioned (i.e. symmetrically) on both sides of the bridge deck. In certain cases, further discussed below, it may be advantageous to provide the damping wings on only one side of the bridge deck. A further possibility is to provide damping wings on both sides of the bridge deck, but to design them differently, that is, in particular, with different widths and lateral eccentricities. Placing damping wings on only one side of the bridge deck, or placing damping wings on both sides of the bridge deck, but designing them differently, may be advantageous when the expected maximum wind speed strongly differs for both transverse directions with regard to the longitudinal direction of the bridge deck. If wings are provided only on one side of the bridge deck then these are placed on the leeward side of the stronger wind. If damping wings are provided on both sides of the bridge deck, but differently embodied, wings with the larger width and lateral eccentricities will be placed on the leeward side of the stronger wind.

The invention is thus based on the further insight that in particular the damping wing arranged on the leeward side of the bridge efficiently dampens the vibrations. More specifically, if the expected maximum wind speeds are about the same for both transverse directions with regard to the longitudinal direction of the bridge deck, damping wings should be placed on both sides of the bridge deck, preferably identical. However, in particular the damping wings provided on the windward side of the bridge deck decrease the overall flutter suppression efficiency of the device. However, even in such a case and based on the above calculation parameters the critical wind speed $U_{cr}$ would still be raised by 28% over the value without damping wings. According to a cost estimate based on a preliminary design, the cost of the support structures and damping wings for such a configuration would amount to 3% to 4% of the costs of the bridge. The costs for achieving an increase in the critical wind speed $U_{cr}$ by 28% through conventional means, for example by increasing the stiffness of the bridge structure can be estimated to be in the same order as the increase of the critical wind speed, that is 28%. The invention is thus also very cost efficient.

According to a further embodiment, it is possible that the damping wings arranged along both sides of the bridge deck are movably supported on the respective support structure and/or are provided with one or more movable elements. As such, upon a change in direction of wind acting on the bridge the damping wings are moved and/or the one or more movable elements are moved whereby the aerodynamics of the damping wings are changed such that the at least one leeward damping wing dampens vibrations of the bridge and the at least one windward damping wing is essentially aerodynamically ineffective such that it has essentially no negative effect on the damping efficiency of the device. The movement of the damping wings and/or the one or more movable elements may be effected solely by wind upon a change in wind direction. Alternatively, it is possible that the damping wings are provided with a drive for effecting movement of the damping wings and/or the one or more movable elements upon a change in wind direction.

As previously explained, the windward damping wing(s) reduce the overall damping efficiency of the device. This possible disadvantage can be addressed by the above explained further embodiments of the invention. In particular, the damping wing(s) may be movably supported on the support structure and/or provided with movable elements. Due to this mobility the damping wing(s) or the movable elements can assume one of two positions. The transition from one position to the other takes place when the wind direction changes from one transverse direction to the other transverse direction, with regard to the longitudinal direction of the bridge deck. The transition may be accomplished by a drive, for example a mechanical drive, requiring a power supply and a control system. However, it is also possible that this transition is driven by wind action alone upon a change in wind direction, therefore not requiring a power supply and a control system. In each case, positions are taken that make the leeward wing(s) aerodynamically effective to dampen vibrations of the bridge and the windward wing(s) aerodynamically ineffective with regard to negative effects on flutter suppression. If a multitude of independent damping wings or movable elements are provided, the system has a high redundancy and thus a high reliability. While the above explained embodiments of the inventive device have movable parts, the respective motions do not occur, and the damping wings are fixed, as long as the wind direction does not change.

There are various possibilities for implementing the idea of movable parts in the inventive device.

In an embodiment, the damping wings may be supported on the support structure and rotatable about a (horizontal) rotational axis transverse to the longitudinal direction of the bridge deck.

In an embodiment, a plurality of comparatively short damping wings may be provided which are supported on rotating bearings mounted to the support structure so that each damping wing can rotate about a horizontal axis transverse to the longitudinal axis of the bridge. Depending on the transverse wind direction acting on the bridge deck and the damping wings, each wing takes one of two positions, namely horizontally aligned or vertically aligned. A leeward damping wing aligns horizontally and is aerodynamically effective to dampen vibrations. A windward damping wing aligns vertically and is aerodynamically essentially ineffective. Again, the transition may be accomplished by a (mechanical) drive or solely by wind action. If it is accomplished by wind action, the outer edge of each damping wing (of the two edges running parallel to the longitudinal axis of the bridge deck) may be shaped in an S-line so that the wind forces create an aerodynamic moment about the bearing axis so that the at least one leeward damping wing is oriented horizontally and the at least one windward damping wing is oriented vertically. The outer edge of each damping wing faces away from the bridge deck irrespective of the wind direction. However, each damping wing can rotate about a horizontal axis transverse to the longitudinal axis of the bridge deck, wherein the rotational position depends on the wind direction. The range of this rotation is limited by suitable stops to a value of 90°.

According to a further embodiment, the movable elements may be flaps arranged on the damping wings pivotable between a first and a second position. In the first position the flaps form part of the closed surface of the respective damping wing, such that the respective damping wing dampens vibrations of the bridge. In the second position the flaps open up the surface of the respective damping wing such that the respective damping wing is essentially aerodynamically ineffective.

In an embodiment, the movable elements are slats arranged on the damping wings and slideable between a first and a second position. In the first position the slats form part of the closed surface of the respective damping wing, such that the respective damping wing dampens vibrations of the bridge. In the second position the slats open up the surface of the respective damping wing such that the respective damping wing is essentially aerodynamically ineffective.

According to the first above explained embodiment, the moveable elements can be implemented for example as pivotable cover flaps mounted along the surface of the damping wing. The range of rotation of these pivotable cover flaps is limited to a value of approximately 180°. Depending on the wind direction, the flaps pivot from a first position, in which they form part of the closed surface of the damping wing, to a second position, in which openings of the damping wing previously located under the flaps are uncovered, thus making the damping wing aerodynamically ineffective.

According to the second above explained embodiment, instead of pivotable cover flaps, laterally guided slats can be provided which can be shifted between a first position forming part of the closed surface of the damping wing and a second position, uncovering openings in the surface of the damping wing and thus rendering the damping wing aerodynamically ineffective.

The flaps or slats can be driven mechanically or by wind action alone. If driven by wind action, the flaps or slats are ballasted and aerodynamically shaped so that the desired transition occurs. Furthermore, the axis of rotation of the pivotable flaps is parallel to the longitudinal axis of the bridge deck and the direction of shifting or sliding of the slats is approximately transverse to the longitudinal axis of the bridge deck. If the flaps or slats are driven mechanically, no limitation exists with regard to the axis of rotation or the direction of sliding.

In an embodiment, it is also possible that the damping wings are supported on the support structure rotatably about a (horizontal) rotational axis parallel to the longitudinal direction of the bridge deck, wherein the damping wings are rotated about this rotational axis by approximately 180° upon a change in wind direction. The movement of the moveable elements of the damping wings may then be effected through rotation of the damping wings upon a change in direction of wind acting on the bridge.

According to such embodiment, movable, namely rotatable damping wings are combined with movable elements. The damping wings are ballasted, supported, and aerodynamically shaped so that, driven by wind forces, they always take the same orientation relative to the wind. This desired behaviour is facilitated by supporting the damping wing at approximately the windward ¼ point where also the center of gravity of the wing should be. The windward wing then takes a first position and the leeward wing takes a second position. When the wind direction changes from one direction transverse to the longitudinal direction of the bridge deck to another direction transverse to the longitudinal direction of the bridge deck, both wings, driven by wind force, automatically change positions. Also in this embodiment, the surfaces of the damping wings may have openings that are either covered or uncovered by movable slats or pivotable flaps. The rotation of the damping wing, when passing from one position to the other position may then be linked, by means of a mechanical link or gear, to the movable elements such that they are shifted from one position to another position as well. The transition from the first wing position to the second wing position may lead to a covering of the openings in the surface of the damping wing by the slats or flaps, while the transition from the second position to the first position may lead to an uncovering of the openings in the surface by the slats or flaps. In this manner, the leeward wing becomes aerodynamically effective and the windward wing becomes aerodynamically ineffective.

In an embodiment, a plurality of damping wings may be arranged behind one another, seen in the longitudinal direction of the bridge deck, along one side of the bridge deck or along both sides of the bridge deck. In that case each damping wing may be embodied according to any of the embodiments explained above. In particular, all wings provided on one side of the bridge deck or on both sides on the bridge deck may be identical with regard to their form and arrangement on the bridge deck.

The invention also pertains to a bridge, in particular a suspension bridge, comprising an inventive device.

BRIEF DESCRIPTION OF THE DRAWINGS

Further exemplary embodiments of the invention will be explained below with reference to schematic drawings.

DETAILED DESCRIPTION OF THE INVENTION

Figure 1:
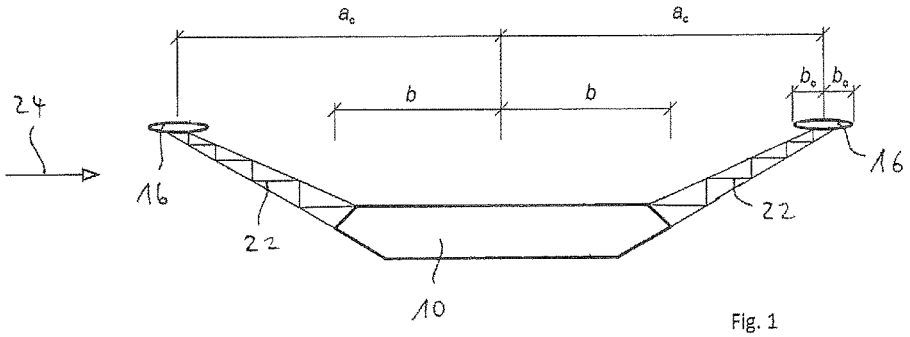
FIG. 1 shows a first embodiment of a bridge fitted with an inventive device in a cross sectional view.
Figure 2:
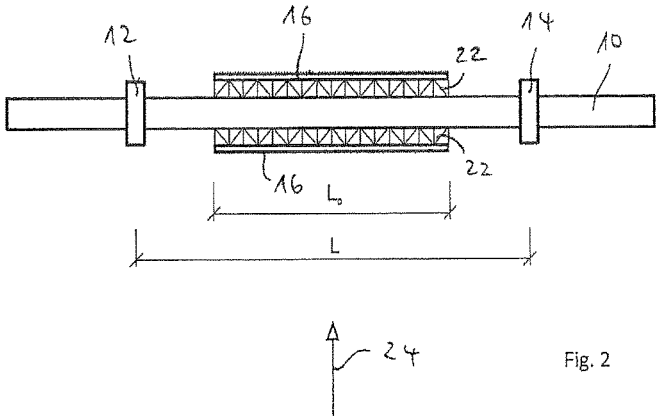
FIG. 2 shows the embodiment of FIG. 1 in a top view.

Unless specified otherwise, the same reference numerals in the drawings denote the same parts. In FIG. 1, reference numeral 10 denotes a bridge deck of a suspension bridge with a large span length. The longitudinal direction of the bridge deck 10 is perpendicular to the plane of projection in FIG. 1. In FIG. 2, which shows a top view of the bridge shown in FIG. 1, two bridge pylons can be seen at reference numerals 12, 14. In FIG. 2 the longitudinal direction of the bridge deck 10 runs from left to right.

In the embodiment shown in FIGS. 1 and 2, one damping wing 16 is provided on each side of the bridge deck 10. As can be seen in particular in FIG. 2, the damping wings 16 are arranged with their longitudinal axes parallel to the longitudinal direction of the bridge deck 10. The damping wings 16 have the form of airfoils in this example and are identical in this embodiment. Each damping wing 16 is held on the bridge deck 10 through a support structure 22. The support structures 22 are each laterally attached to the bridge deck such that each damping wing 16 is arranged with a lateral offset from the outer edge of the bridge deck 10 facing the respective damping wing 16. In the embodiment shown in FIGS. 1 and 2, the distance $a_c$ between the center of each of the damping wings 16 and the center of the bridge deck 10 is approximately 2 times larger than half the width of the bridge deck 10. Also, in this example the width of the damping wings 16 in a direction transverse to their respective longitudinal direction, which is denoted in FIG. 1 by $2*b_c$ is at least 0.1 times the width of the bridge deck 10, which is denoted by 2*b in FIG. 1. Furthermore, through the support structures 22 each of the damping wings 16 is positioned above the bridge deck 10 (i.e. also has a vertical offset from the bridge deck 10). The profile of the damping wings 16, which can be seen in FIG. 1, is symmetrical relative to a horizontal plane in this example. The damping wings 16 are stationary (i.e. do not move upon wind acting on the bridge in a given direction) as shown in FIGS. 1 and 2 by arrows 24.

Figure 3:
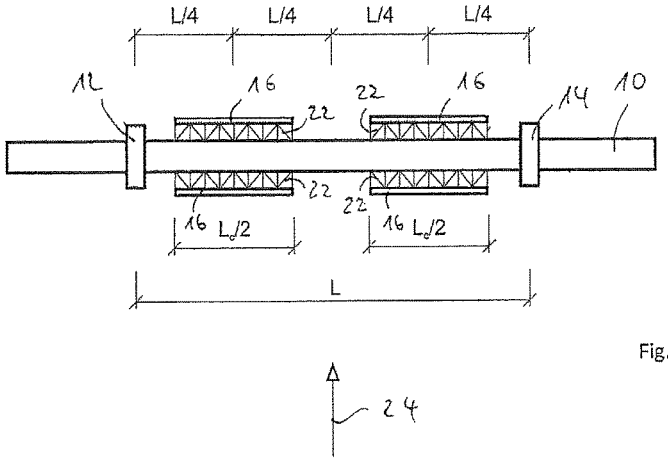
FIG. 3 shows a top view similar to FIG. 2 according to a further embodiment.

FIG. 3 shows an alternative embodiment which is similar to the embodiment shown in FIGS. 1 and 2. The only difference in this embodiment is that on each side of the bridge deck 10 two shorter damping wings 16 are provided behind one another, seen in the longitudinal direction of the bridge deck 10. While in FIG. 2 the damping wings 16 are arranged at the center of the main span of the suspension bridge over a length Lc, wherein L is the overall span length between the two pylons 12, 14, in FIG. 3 damping wings 16 are arranged in regions around the quarter points of the main span of the bridge deck 10, each with a length of Lc/2. In both cases Lc is smaller than L. The embodiment of FIG. 2 is particularly suitable in case flutter of the bridge is governed by the first symmetric modes of vibrations. The embodiment of FIG. 3 is particularly suited in case flutter of the bridge is governed by the first antisymmetric modes of vibration.

Figure 4:
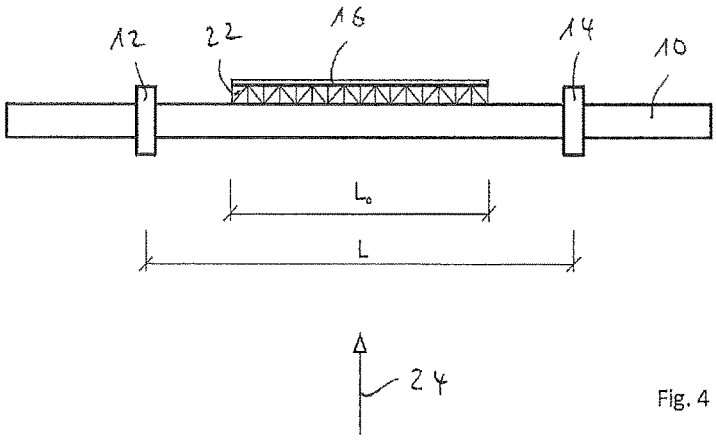
FIG. 4 shows a top view similar to FIG. 2 according to a further embodiment.
Figure 5:
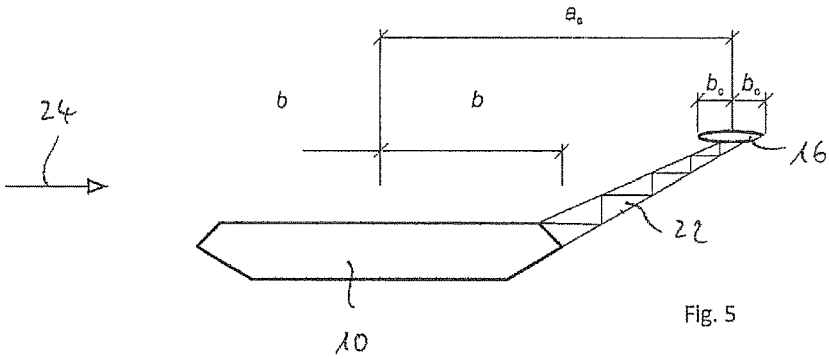
FIG. 5 shows a cross sectional view through the embodiment of FIG. 4.

In the embodiment shown in FIGS. 1 to 3, damping wings 16 are provided on both sides of the bridge deck 10, thus being able to deal with changing transverse wind directions. If the wind essentially only comes from one transverse direction, it may be preferable to provide a damping wing 16 only on one side of the bridge deck 10, as shown in FIGS. 4 and 5. In this case the damping wing 16 is provided on the leeward side and may otherwise be arranged and formed identical to the damping wings 16 shown in FIGS. 1 to 3.

Figure 6:
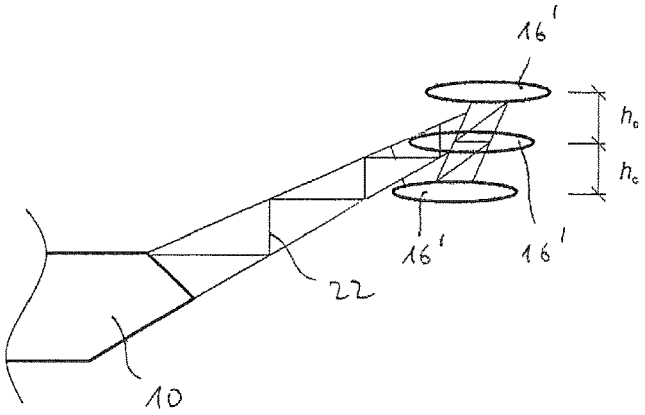
FIG. 6 shows a further embodiment of a bridge fitted with an inventive device in a partial cross sectional view.

FIG. 6 shows a further embodiment wherein instead of one damping wing, a plurality of damping wings 16' are arranged on the support structure 22 above one another and possibly with a slight lateral offset from one another. The sum of the widths of the three damping wings 16' shown in FIG. 6 may be the same as the width of one of the damping wings 16 shown in FIGS. 1 to 5. The plurality of damping wings 16' in FIG. 6 may then have the same efficiency with regard to vibrational damping while being less susceptible to vertical velocity components of turbulent wind by taking advantage of the wind shielding effect provided by the uppermost or lowermost damping wings 16'.

Figure 7:
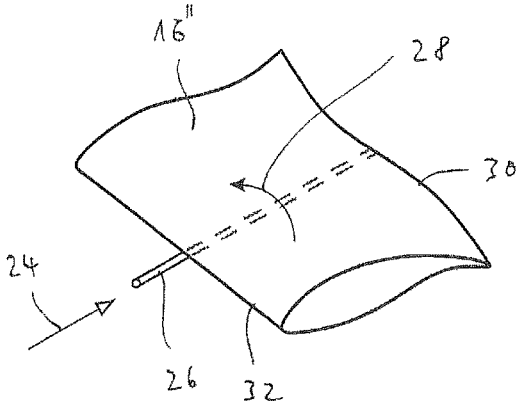
FIG. 7 shows a damping wing of an inventive device in a perspective view according to a further embodiment.

FIG. 7 shows a further embodiment of a damping wing 16" in a perspective view. As can be seen, the damping wing 16" in FIG. 7 is supported rotatably about an axis 26, as also visualised by arrow 28. The outer edge 30 of damping wing 16" has an S-shape. In this embodiment the S-shaped outer edge for damping wings provided on both sides of the bridge deck always faces away from the bridge deck, irrespective of the wind direction (i.e. irrespective of whether the damping wing is leeward or windward). Upon wind acting along the arrow 24 shown in FIG. 7 the damping wing 16" in FIG. 7 rotates about rotational axis 26 as shown by arrow 28 by 90°. Corresponding stops can limit the rotation to the value of 90°. The wind acting onto the front edge 32 of the damping wing 16" as shown by arrow 24 in FIG. 7 leads to the damping wing 16" assuming a horizontal position, as shown in FIG. 7 which renders the damping wing 16" aerodynamically effective such that it dampens vibrations. If, on the other hand, the wind direction would be opposite than shown in FIG. 7 the damping wing 16" would rotate in the counter direction than shown by arrow 28 in FIG. 7 and to a vertical position which renders the damping wing aerodynamically ineffective so that it does not negatively affect the damping efficiency of the inventive device.

Figure 8:
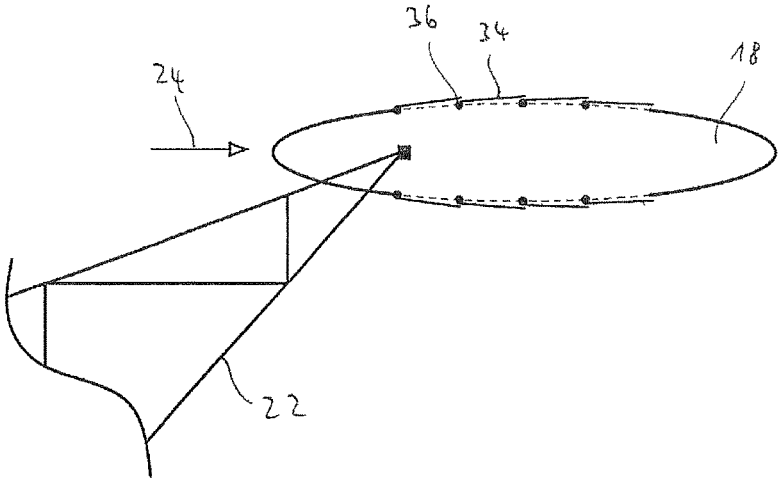
FIG. 8 shows part of an inventive device in a cross sectional view according to a further embodiment.
Figure 9:
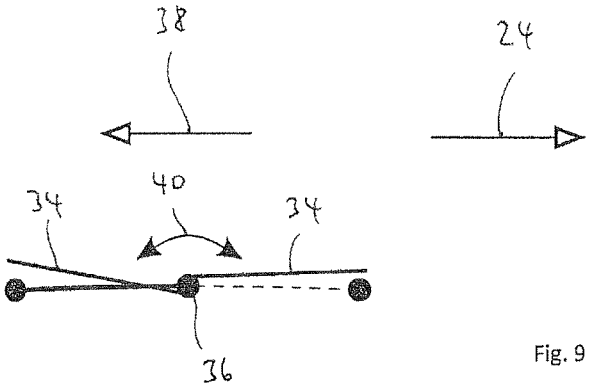
FIG. 9 shows an enlarged detail of the device of FIG. 8.

A further embodiment is shown in FIGS. 8 and 9. The damping wing 18 in this embodiment is provided with a number of flaps 34 each pivotable about an axis 36. In the position shown in FIG. 8 the flaps 34 form part of the closed surface of the damping wing 18 such that the damping wing 18 is aerodynamically effective for damping vibrations. This position is taken upon a wind direction as shown by arrow 24 in FIG. 8. The damping wing 18 is then the leeward damping wing. If the wind direction is opposite, as shown in FIG. 9 by arrow 38, the flaps 34 pivot about axis 36 as shown in FIG. 9 by arrow 40 by approximately 180° such that the openings in the surface of the damping wing 18 previously closed are now open which thus renders the damping wing 18 aerodynamically ineffective. This position is assumed when the damping wing is the windward wing.

Figure 10:
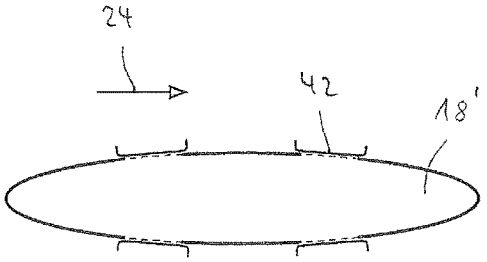
FIG. 10 shows a damping wing of an inventive device according to a further embodiment in a first state in a cross sectional view.
Figure 11:
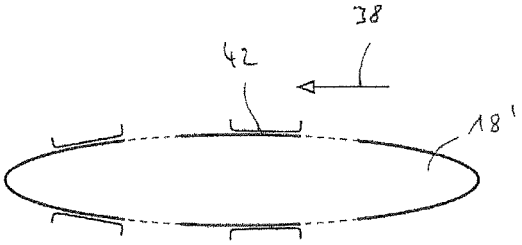
FIG. 11 shows the damping wing of FIG. 10 in a second state in a cross sectional view.

A further embodiment is shown in FIGS. 10 and 11. In this damping wing 18' slats 42 are provided which are slideable between the position shown in FIG. 10 where the slats 42 form part of the closed surface of the damping wing 18' and the position shown in FIG. 11 where the slats 42 uncover openings in the surface of the damping wing 18'. The position shown in FIG. 10 is assumed upon a wind direction as shown at reference numeral 24 when the damping wing 18' is the leeward wing and thus aerodynamically effective for damping vibrations. The position shown in FIG. 11 is assumed upon an opposite wind direction 38 when the damping wing 18' is the windward wing and thus aerodynamically ineffective.

Figure 12:
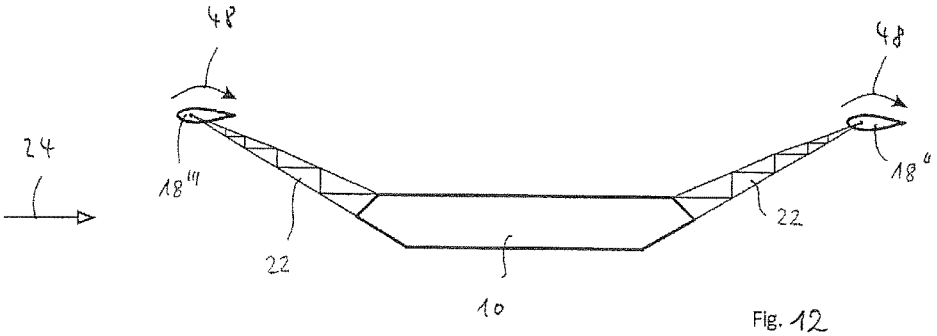
FIG. 12 shows a bridge fitted with an inventive device with damping wings as shown in FIGS. 13 and 14.
Figure 13:
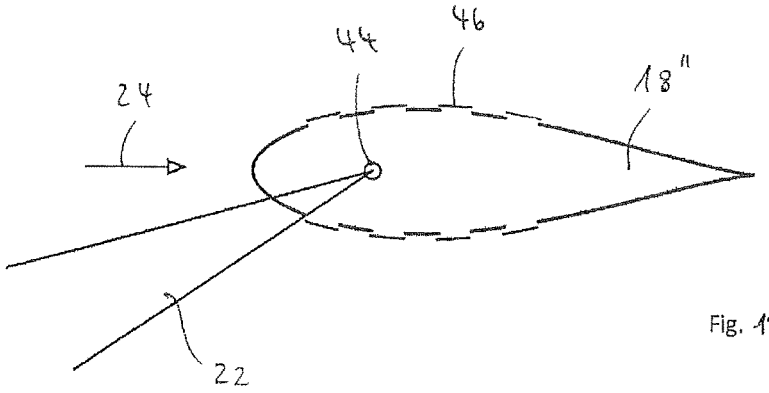
FIG. 13 shows a damping wing of an inventive device according to a further embodiment in a first state in a cross sectional view, as shown in FIG. 12.
Figure 14:
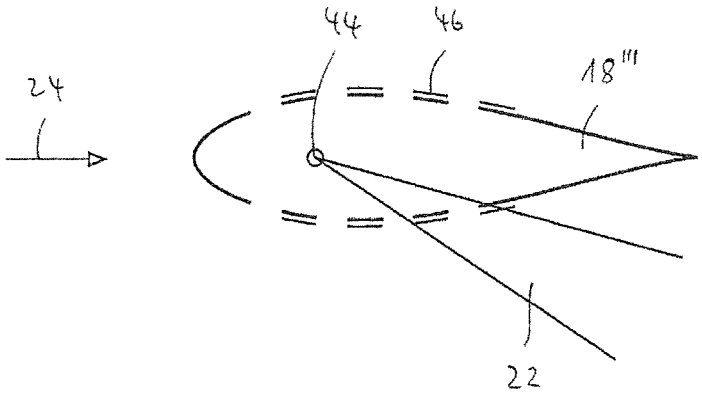
FIG. 14 shows the damping wing in a second state in a cross sectional view, as shown in FIG. 12.

FIGS. 12 to 14 show a further embodiment of damping wings 18", 18''', wherein these damping wings 18", 18''' are each rotatably supported around rotational axis 44 on support structures 22. Again, a number of slideable slats 46 are provided which in a first position, shown in FIG. 13 for damping wing 18", form part of the closed surface of the damping wings 18", 18''' and in a second position, shown in FIG. 14 for damping wing 18''', uncover openings in the surface of the damping wings 18", 18'''. In the embodiment shown in FIGS. 12 to 14, the damping wings 18", 18''' can rotate about rotational axis 44 which is parallel to the longitudinal direction of the bridge deck 10. They are ballasted, supported, and aerodynamically shaped so that a wind force in the direction of arrow 24 leads to the damping wings 18", 18''' assuming the same orientation towards the wind, as shown in particular in FIG. 12. Arrows 48 visualise the rotational movement of the damping wings 18", 18'''. In the embodiment shown in FIGS. 12 to 14, there is a link, for example a mechanical link or gear, which makes the slats 46 move between the positions shown in FIGS. 13 and 14 upon a rotation of the damping wings 18", 18'''.

While the damping wings 18", 18''' assume the same position relative to the wind as shown in FIG. 12, their slats 46 assume different positions as seen from a comparison of FIGS. 13 and 14. More specifically, in the situation shown in FIG. 12 the slats 46 of the windward damping wing 18''' are uncovering the openings in the surface of the damping wing 18''' while the slats 46 in the leeward damping wing 18'' are closing these openings thus forming part of the closed surface of the damping wing 18''. As a result, damping wing 18'' is aerodynamically effective to dampen vibrations of the bridge while damping wing 18''' is aerodynamically ineffective.

All of the above explained embodiments can be combined with one another.

The invention claimed is:

1. A damping device for damping vibrations of a bridge having a bridge deck, the damping device comprising:

at least one damping wing comprising a center and configured to dampen vibrations of the bridge, wherein a longitudinal direction of the at least one damping wing is disposed parallel to a longitudinal direction of the bridge deck, and wherein the at least one damping wing is stationary upon wind acting on the bridge in a given direction; and at least one support structure laterally attached to at least one side of the bridge deck and configured to attach the at least one damping wing to the bridge deck such that the at least one damping wing is disposed with a lateral offset from an outer edge of the bridge deck facing the at least one damping wing, wherein a distance between the center of the at least one damping wing and a center of the bridge deck is at least 1.2 times larger than half a width of the bridge deck.

2. The damping device according to claim 1, wherein the width of the at least one damping wing in a direction transverse to the longitudinal direction of the at least one damping wing is at least 0.02 times the width of the bridge deck.

3. The damping device according to claim 1, wherein the at least one damping wing is coupled to the at least one support structure such that the at least one damping wing is laterally offset from the outer edge of the bridge deck facing the at least one damping wing and positioned above or below the bridge deck.

4. The damping device according to claim 1, wherein the at least one damping wing comprises a profile in a direction transverse to its longitudinal direction that is symmetrical relative to a horizontal plane.

5. The damping device according to claim 1, wherein the one or more damping wings are rotatably coupled to the at least one support structure and configured to rotate about an axis, the axis disposed parallel to the longitudinal direction of the bridge deck.

6. The damping device according to claim 1, further comprising a plurality of damping wings disposed behind one another along the longitudinal direction of the bridge deck.

7. The damping device according to claim 1, further comprising a plurality of damping wings coupled to the at least one support structure and laterally offset from the outer edge of the bridge deck facing the plurality of damping wings, wherein the plurality of damping wings are disposed above one another.

8. The damping device according to claim 7, wherein the plurality of damping wings are laterally offset from one another.

9. The damping device according to claim 8, wherein a sum of widths of the plurality of damping wings is at least 0.02 times the width of the bridge deck.

10. The damping device according to claim 8, wherein the plurality of damping wings are disposed along both sides of the bridge deck and differ from one another with regard to at least one of their form or their arrangement relative to the bridge deck.

11. The damping device according to claim 8, wherein the plurality of damping wings are disposed along both sides of the bridge deck and are identical with regard to their form and arrangement relative to the bridge deck.

12. The damping device according to claim 11, wherein the plurality of damping wings are movably coupled to the at least one support structure and configured to change aerodynamic properties of the plurality of damping wings such that at least one leeward damping wing dampens vibrations of the bridge and at least one windward damping wing is aerodynamically ineffective.

13. The damping device according to claim 12, wherein movement of the plurality of damping wings is effected solely by wind direction.

14. The damping device according to claim 12, further comprising one or more mechanical links configured to drive movement of the plurality of damping wings.

15. The damping device according to claim 11, wherein the plurality of damping wings further comprise one or more movable elements configured to change aerodynamic properties of the plurality of damping wings such that at least one leeward damping wing dampens vibrations of the bridge and at least one windward damping wing is aerodynamically ineffective.

16. The damping device according to claim 15, wherein the one or more movable elements are flaps configured to pivot between a closed position and an open position, wherein the closed position is configured to dampen vibrations of the bridge, and wherein the open position is configured to be essentially aerodynamically ineffective.

17. The damping device according to claim 15, wherein the one or more movable elements are slats configured to slide between a closed position and an open position, wherein the closed position is configured to dampen vibrations of the bridge, and wherein the open position is configured to be essentially aerodynamically ineffective.

18. The damping device according to claim 15, wherein movement of the one or more movable elements is effected through movement of the plurality of damping wings by a change in wind direction.

19. The damping device according to claim 1, wherein the at least one damping wing is rotatably coupled to the at least one support structure and configured to rotate about an axis, the axis disposed transverse to the longitudinal direction of the bridge deck.

20. The damping device according to claim 19, wherein the at least one damping wing further comprises an outer edge having an S-shape, wherein the at least one damping wing is configured to rotate about the axis by approximately 90°.

* * * * *